US010668357B2

(12) United States Patent
Szilagy et al.

(10) Patent No.: US 10,668,357 B2
(45) Date of Patent: Jun. 2, 2020

(54) SINGLE FINGER GOLF GLOVE

(71) Applicant: One Golf Glove, LLC, Indianapolis, IN (US)

(72) Inventors: Chris Szilagy, Indianapolis, IN (US); David Fleetwood, Indianapolis, IN (US); Thomas Clark, Greenfield, IN (US)

(73) Assignee: Strokeless, LLC, Indianapolis, IN (US)

( * ) Notice: Subject to any disclaimer, the term of this patent is extended or adjusted under 35 U.S.C. 154(b) by 15 days.

(21) Appl. No.: 16/037,344

(22) Filed: Jul. 17, 2018

(65) Prior Publication Data

US 2019/0091549 A1 Mar. 28, 2019

Related U.S. Application Data

(60) Provisional application No. 62/562,492, filed on Sep. 25, 2017.

(51) Int. Cl.

| | |
|---|---|
| ***A63B 71/14*** | (2006.01) |
| ***A41D 19/00*** | (2006.01) |
| *A41F 1/06* | (2006.01) |
| *A63B 69/36* | (2006.01) |

(52) U.S. Cl.

CPC ..... *A63B 71/146* (2013.01); *A41D 19/00* (2013.01); *A41F 1/06* (2013.01); *A63B 69/3608* (2013.01); *A63B 2209/00* (2013.01); *A63B 2209/10* (2013.01)

(58) Field of Classification Search

CPC .... A41D 13/081; A41D 13/082; A41D 19/00; A41D 19/01547; A41D 19/01552; A41D 19/01582; A63B 71/146; A63B 21/4019; A63B 71/14; A63B 71/141; A63B 69/3608; A63B 2209/10; A63B 2209/00; A41F 1/06

USPC ..... 2/20, 161.2

See application file for complete search history.

(56) References Cited

U.S. PATENT DOCUMENTS

| | | | | | |
|---|---|---|---|---|---|
| 578,852 | A * | 3/1897 | Barke | A41D 13/082 | 2/20 |
| 2,496,808 | A * | 2/1950 | Moore | A63B 53/14 | 473/205 |
| 2,867,814 | A * | 1/1959 | Miles, Jr. | A63B 71/146 | 2/20 |
| 3,178,724 | A * | 4/1965 | Perschke | A41D 13/082 | 2/16 |
| 3,344,436 | A * | 10/1967 | Stubbs | A63B 71/148 | 2/159 |

(Continued)

FOREIGN PATENT DOCUMENTS

| | | | | |
|---|---|---|---|---|
| WO | WO-9400030 A1 * | 1/1994 | ..... | A63B 71/146 |
| WO | WO-9524136 A1 * | 9/1995 | ..... | A41D 13/082 |

*Primary Examiner* — Amy Vanatta

(74) *Attorney, Agent, or Firm* — Maginot, Moore & Beck, LLP

(57) ABSTRACT

A one finger golf glove is formed as a unitary pattern from a single sheet of material, the unitary pattern including a palm portion arranged at the palm of the golfer's hand and a finger portion arranged at the middle finger and ring finger of the golfer's hand. The glove includes a finger sleeve arranged to receive only the middle finger of the golfer's hand. A strap extends from the palm portion and is sized to extend across the back of the golfer's hand, through a slot in the glove and around the golfer's wrist.

13 Claims, 7 Drawing Sheets

(56) References Cited

U.S. PATENT DOCUMENTS

| | | | | | |
|---|---|---|---|---|---|
| 3,381,304 | A | * | 5/1968 | Coco | A41D 13/082 2/20 |
| 3,411,159 | A | * | 11/1968 | Berkhemer | A63B 71/146 2/159 |
| 3,726,525 | A | * | 4/1973 | Jackson | A63D 5/00 473/61 |
| D256,401 | S | * | 8/1980 | Adams | A41D 13/082 D29/113 |
| D352,134 | S | * | 11/1994 | Crowder | A63B 71/148 D29/113 |
| 5,557,805 | A | * | 9/1996 | Emerson | A41D 13/081 2/158 |
| 5,685,787 | A | * | 11/1997 | Kogut | A63B 69/3608 473/205 |
| 5,689,828 | A | * | 11/1997 | Mah | A63B 71/148 2/16 |
| 9,643,073 | B1 | * | 5/2017 | Pellegrino | A63B 71/141 |
| 2002/0077200 | A1 | * | 6/2002 | Kreutzer | A63B 69/0059 473/450 |
| 2009/0275418 | A1 | * | 11/2009 | Whitehead, II | A63B 71/148 473/60 |
| 2014/0189925 | A1 | | 7/2014 | Ramirez | |
| 2014/0373251 | A1 | | 12/2014 | Ramirez | |
| 2016/0303462 | A1 | | 10/2016 | Ramirez | |

* cited by examiner

SINGLE FINGER GOLF GLOVE

PRIORITY CLAIM

This application is a utility filing from and claims priority to U.S. Provisional Application No. 62/562,492, entitled "Strokeless Golf Grip", filed on Sep. 25, 2017, the entire disclosure of which is incorporated herein.

BACKGROUND

The present disclosure concerns sports gloves, and particularly a glove for golfing.

The typical golf glove is configured to cover the entire hand, from the wrist to the tips of each digit. Most golfers use a single glove on their non-dominant hand to improve the grip of the golf club. The typical golfer does not wear a glove on the dominant hand, in part to maintain a "feel" for the golf club. Having a "feel" of the club is often regarded as an important part of the golf swing.

However, the "feel" for the golf club is not limited to just the dominant hand. Many golfers remove the glove when putting in order to enhance the "feel" of the club during putting. Maintaining a "feel" for the golf club in the non-dominant hand can also benefit the golfer when swinging an iron, wood or driver. The golfer's "feel" is not limited to the fingers, but instead includes the entire hand, from fingers to palm. However, the typical golf glove covers the entire hand so that the golfer has no sense of the club in his/her non-dominant hand, other than the pressure of the grip.

The conventional golf glove also presents an inconvenience to the golfer apart from in swinging the golf club. In particular, the golf glove makes it difficult for the golfer to do anything with the gloved hand other than swing a club. The glove material makes it difficult to put a hand into a pocket, such as to retrieve a ball marker. The full coverage of the glove inevitably leads to significant sweating in warmer weather. The sweaty palms compromise the golfer's ability to solidly grip the club, and if the golfer sweats enough the glove material itself becomes wet, further compromising the golfer's grip. This problem can be easily avoided by removing the glove after every golf shot, but this is yet another inconvenience. Golfers often wear rings, and while a conventional band-type ring fits easily within a glove, a larger ring, such as a diamond or jeweled ring, does not fit easily into the glove. Moreover, the larger ring can cause discomfort to the golfer. Thus, many golfers are forced to remove the ring in order to play golf.

Consequently, there is a need for an improved golf glove that avoids these problems without compromising the golfer's grip on the golf club.

SUMMARY OF THE DISCLOSURE

The present disclosure provides a one-fingered golf glove that comprises a sheet including a surface for contacting the grip of a golf club and an opposite surface for contacting only a portion of the golfer's hand. The sheet is formed as a pattern in a single sheet of material that includes a palm portion sized to cover less than the entire palm of the golfer's hand and a finger portion sized to cover a portion of only the middle and ring fingers of the golfer's hand. In one aspect the glove includes a finger sleeve attached to the finger portion of the sheet that is sized to receive only the middle finger of the golfer's hand therethrough. An attachment strap extends from the sheet and is sized and arranged to pass over the back of the golfer's hand and wrap around the wrist. The strap extends through a slot in an attachment flap of the sheet to secure the glove to the golfer's hand.

In one feature, the golf glove disclosed herein allows the majority of the golfer's hand to remain uncovered by the material of the glove. This feature enhances the "feel" that the golfer has when gripping the golf club and frees the golfer's fingers to perform other tasks apart from gripping a golf club.

DETAILED DESCRIPTION

Figure 1:
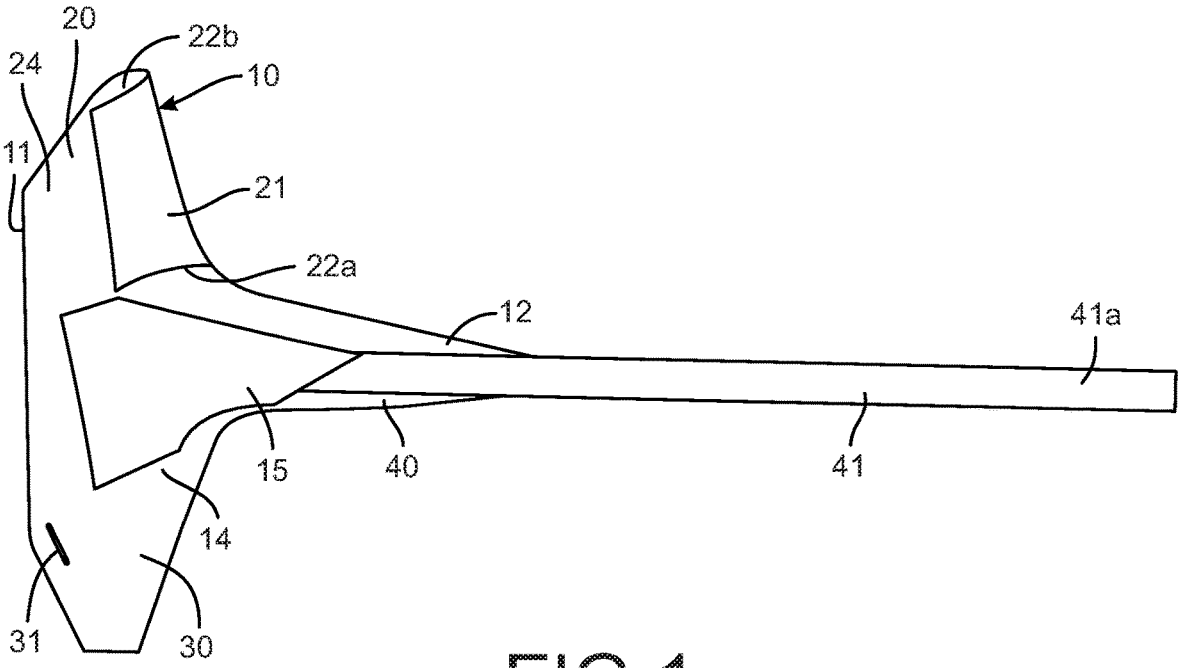
FIG. 1 is a plan view of a one side of a golf glove according to the present disclosure.
Figure 2:
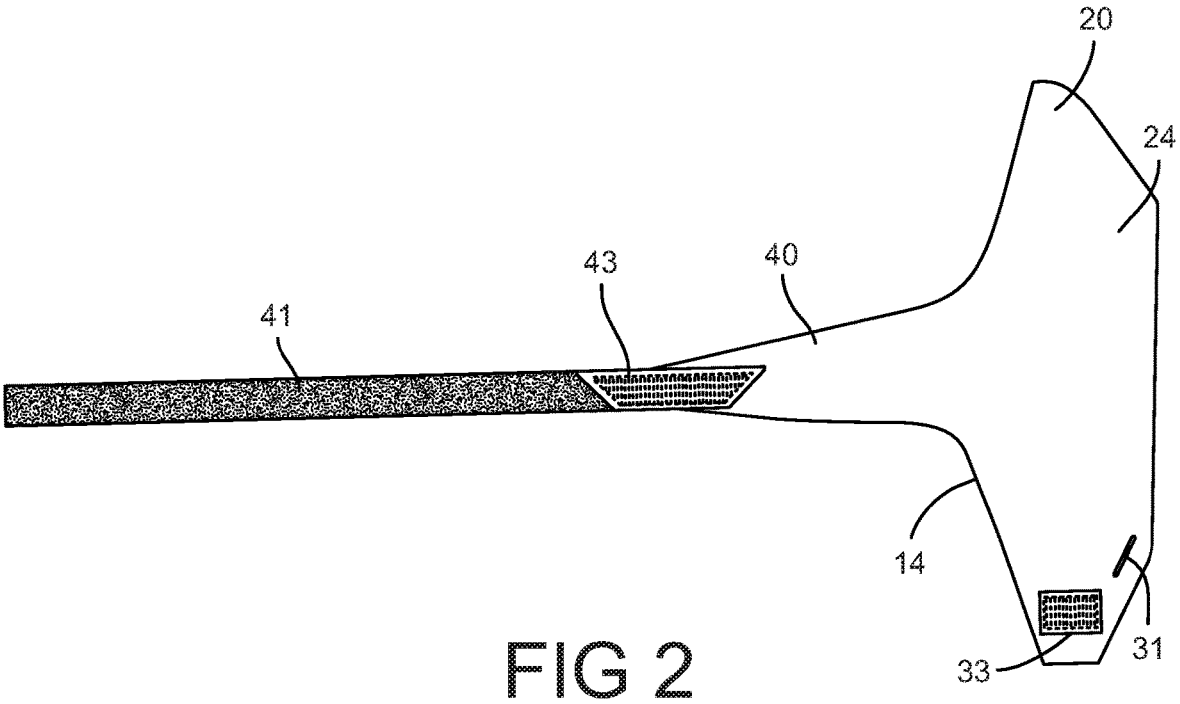
FIG. 2 is a plan view of the opposite side of the golf glove shown in FIG. 1.

For the purposes of promoting an understanding of the principles of the disclosure, reference will now be made to the embodiments illustrated in the drawings and described in the following written specification. It is understood that no limitation to the scope of the disclosure is thereby intended. It is further understood that the present disclosure includes any alterations and modifications to the illustrated embodiments and includes further applications of the principles disclosed herein as would normally occur to one skilled in the art to which this disclosure pertains A golf glove 10 is shown in FIGS. 1-2 that is essentially formed as sheet or pattern 11 of material suitable for use in gripping a golf club. The sheet includes a strap portion 12 configured for engaging the glove about the hand and wrist of the golfer, and a palm portion 14 configured for gripping the grip of the golf club. In one embodiment, the sheet 11 is a cloth, leather or hide material adapted to provide a friction surface for gripping the grip of the golf club. The palm portion 14 may include a separate palm panel 15 or cover of a further material suitable for contact with the skin of the golfer's palm. In one specific embodiment, the sheet 11 can be formed of a leather or hide material, or a breathable natural or synthetic fabric, that provides a strong gripping surface. The palm panel 15 may be formed of a material that is soft to the touch and moisture absorbent, including any of the materials used for the sheet 11. The palm panel 15 preferably at least spans the surface of the golfer's palm that is in contact with the golf club, although it is contemplated that the palm panel 15 may span the entire side of the sheet 11 facing the golfer's hand.

Figure 3A:
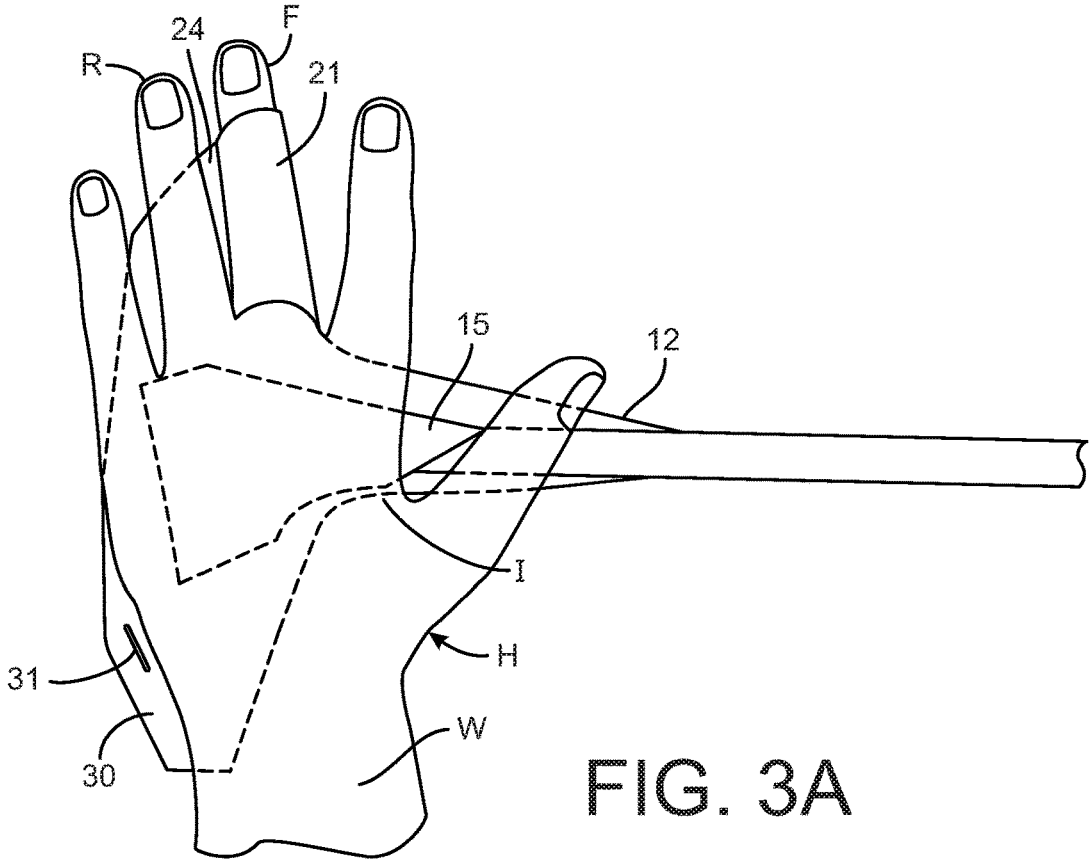
FIGS. 3*a*, 3*b* show the golf glove of FIGS. 1-2 on a golfer's hand in a first stage of placing the glove on the hand.
Figure 3B:
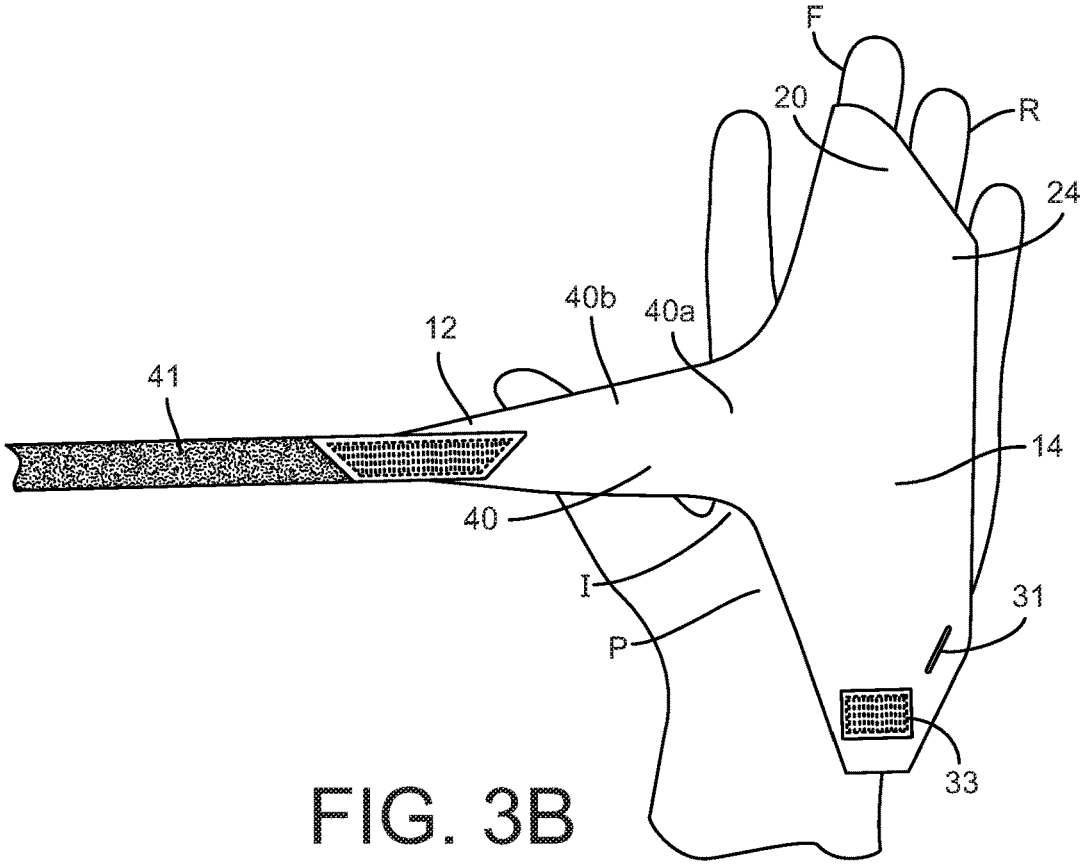

The sheet 11 includes a finger portion 20 that is integral with the palm portion 14 and is arranged to align with the middle finger F and ring finger R of the golfer, as shown in FIGS. 3*a*-3*b*. The finger portion includes an elongated finger sleeve 21 having openings 22*a*, 22*b* at its opposite ends to receive the middle finger F therethrough, as best seen in FIG. 3*a*. The sleeve 21 may be formed of the same material as the sheet 11 that is sewn, adhered or otherwise attached to the finger portion 20 of the glove. Alternatively, the sleeve 21 may be formed of an elastic material that stretches when the golfer inserts his/her middle finger F into the sleeve, such as the segmented copolymeretherester elastomers manufactured by DuPont De Nemours under the trade name Spandex. The material of the sleeve 21 is preferably comfortable to the skin of the golfer's hand and suitable for extended wear during one or more rounds of golf. The material of the finger sleeve 21 may be absorbable or breathable to help account for sweat. The sleeve 21 is arranged on the sheet 11 so that the golfer inserts his/her finger into the opening 22*a* at the bottom of the sleeve until the tip of the finger extends beyond the opening 22*b* at the end of the sleeve, as depicted in FIGS. 3*a*-3*b*.

The finger portion 20 further includes a finger flap 24 that is arranged at the side of the finger sleeve 21. In particular, the flap 24 is arranged to overlap the ring finger R of the golfer, as shown in FIGS. 3*a*-3*b*. The flap provides a friction interface between the ring finger and the golf club grip when the golfer grips the club, but allows the ring finger to remain unfettered otherwise. The finger flap 24 is sized so that the golfer need not have his/her ring finger R immediately adjacent the middle finger F when gripping the club. The finger flap 24 is preferably integral with and formed of the same material the sheet 11 and palm portion 14. However, the finger flap could be formed of a different material and be separate from the palm portion, but connected to the palm section to form a one-piece glove. It is thus contemplated that the finger flap will include a material facing the golf club that is configured to enhance the golfer's grip on the club, just like the sheet 11. The finger flap 24 may include a surface facing the golfer's ring finger R that is similar to the palm panel 15, and more particularly formed of a material that is comfortable to the skin of the golfer's finger.

The sheet 11 further includes an attachment flap 30 at a lower portion of the sheet that is oriented at the base of the golfer's palm or at the golfer's wrist when the glove is worn, as depicted in FIGS. 3*a*, 3*b*. the attachment flap 30 is preferably one-piece with the remainder of the sheet 11, but like the finger flap may be a separate component that is attached to the palm portion to form a one-piece glove. Since the attachment flap 30 ideally does not contact the golf club (assuming a conventional golf swing), the material of the flap need not be formed of the same material as the portion of the sheet 11 that is in contact with the golf club grip and the user's hand. Nevertheless, for simplicity in production the flap 30, as well as the palm portion 14 and finger portion 20, is formed form a common sheet of material. Additional material may be added to either surface of the sheet 11, such as the palm panel 15, as desired to enhance the grip or improve the comfort to the golfer's skin.

The strap portion 12 is also preferably integral or one with the sheet 11 forming the golf glove 10, along with the other portions described above. The strap portion 12 includes a hand section 40 that is arranged to overlap the hand of the user when the strap portion is used to hold the glove 10 on the golfer's hand. The strap portion 12 further includes an attachment strap 41 that is used to tightly engage the strap portion and thus the glove on the hand of the golfer. In one embodiment, the hand section 40 of the strap portion 12 is formed of the same material as the sheet 11, and part of the same piece of material that forms the palm portion 14 and finger portion 20. As described herein, part 40*a* of the hand section 40 extends across the upper palm of the golfer's hand, while the remaining part 40*b* of the hand section extends across the back of the golfer's hand. The first part 40*a* may be formed of a material suitable for gripping the golf club, while the second part 40*b* need not have the same grip characteristics. In both cases, the parts 40*a*, 40*b* have an inner surface facing the hand of the golfer that is comfortable to the golfer's skin. Although the second part 40*b* need not be formed of the same material as the first part 40*a* and remainder of the sheet 11, it is preferable that it be formed form the same sheet of material to facilitate production of the glove. In other words, it is contemplated that the sheet 11 encompasses the palm portion 14, finger portion 20 and hand section 40 of the strap portion 12. The sheet 11 may also encompass the attachment strap 41 of the strap portion 12. However, as described herein, the inner surface of the attachment strap 41 preferably includes a surface adapted for attachment to a hook-and-loop fastener. In that regard, the attachment flap 30 includes an attachment pad 33 on the outer surface of the flap, and the strap portion 12 includes an attachment pad 43 also provided on the outer surface of the portion. The two attachment pads 33, 43 are formed of a material that permits attachment, removal and re-attachment of the strap portion 12 thereto. Thus, in one embodiment, the two attachment pads 33, 43 include a hook and loop fastener construction and the inner surface of the attachment strap 41 is configured for releasable engagement to those fastener constructions. While a hook and loop fastener arrangement is preferred, other releasable fastener constructions are contemplated that allow the attachment strap to be attached and removed without compromising the strength of the attachment after repeated use.

The manner of donning the glove 10 is shown in the sequence of figures from FIGS. 3*a*-*b* to FIGS. 6*a*-*b*. The golfer starts by extending the middle finger F through the finger sleeve 21, preferably until the attachment pad 43 in the attachment flap 30 is adjacent the golfer's wrist W or at the junction between the golfer's palm P and wrist W. The finger sleeve 21 may be tapered from the opening 22*a* to the opposite opening 22*b* to provide natural resistance as the finger is pushed into the sleeve. As seen in FIG. 3*a*, the palm section 15 is aligned with the portion of the golfer's palm P that is used to grip the golf club. As seen in FIG. 3*b*, the finger flap 24 is arranged to cover the ring finger R of the golfer's hand. It can thus be appreciated that only two of four of the golfer's fingers are covered with material when gripping the golf club. Or more pertinently, two of the fingers, the index finger and pinky finger, are exposed to the golf club and can be used to directly grip the club, thereby enhancing the "feel" discussed above.

Figure 4A:
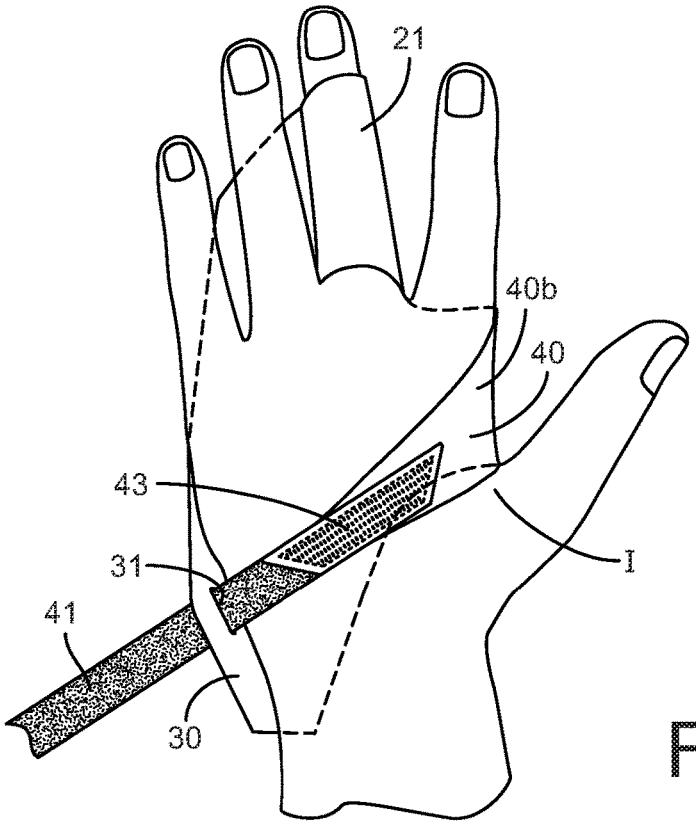
FIGS. 4*a*, 4*b* show the golf glove of FIGS. 1-2 on a golfer's hand in a second stage of placing the glove on the hand.
Figure 4B:
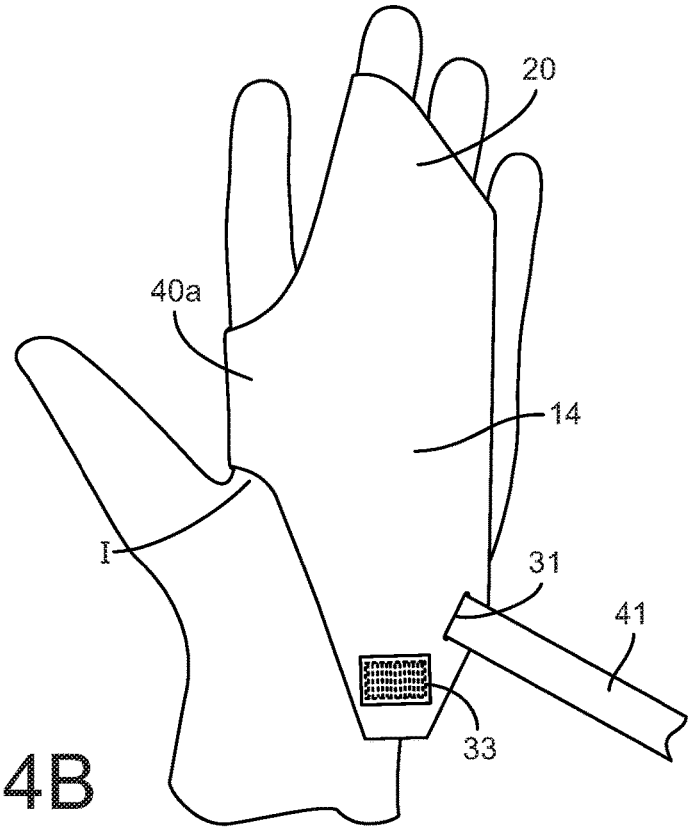

As depicted in FIGS. 4*a*-4*b*, with the glove mounted on the hand, the strap portion 12 can be extended across the back of the golfer's hand with the hand section 40 wrapping around the palmar interossei I (i.e., the space between thumb and forefinger) of the golfer's hand. The attachment strap 41 is then threaded through a slot 31 in the attachment flap 30. It can be appreciated that the slot is sized to readily receive the strap therethrough. The slot 31 can be formed directly in the material of the attachment flap 30, such as by sewing around the perimeter of an opening in the flap, or can be formed by a ferrule embedded within the material of the flap.

The attachment strap 41 is pulled through the slot so that the hand section 40 of the strap portion 12 bears tightly against the back of the hand. The strap can be tightened according to the golfer's comfort. However, it can be appreciated that the engagement of the middle finger F through the finger sleeve 21 and pressure of the golf club on the palm section 14 of the glove is generally sufficient to keep the glove 10 in position on the golfer's hand during a swing. It can be appreciated that the glove 10 can be prepared in advance of placing on the hand by threading the strap 41 loosely through the slot 31. In that case, the golfer would pass his hand through the space formed by the loosely positioned strap and the sheet 11 and then insert the middle finger F into the finger sleeve 21.

Figure 5A:
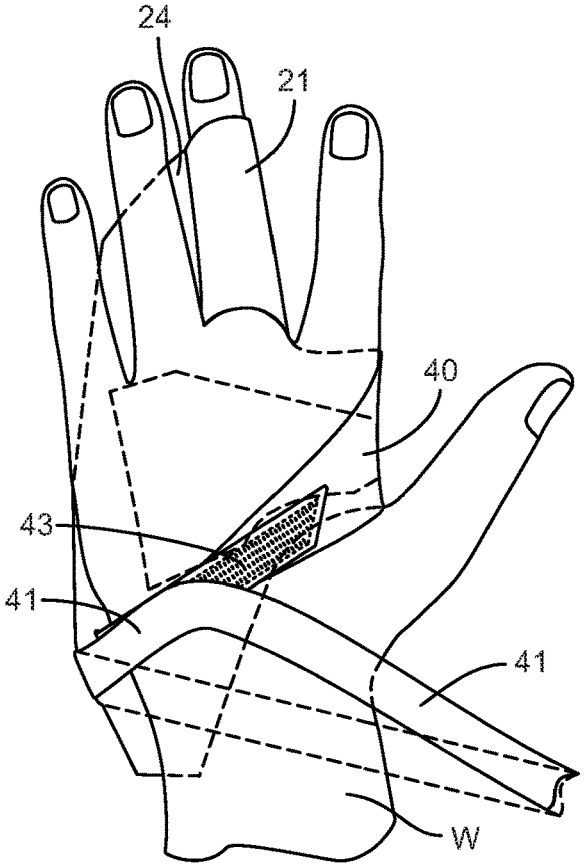
FIGS. 5*a*, 5*b* show the golf glove of FIGS. 1-2 on a golfer's hand in a third stage of placing the glove on the hand.
Figure 5B:
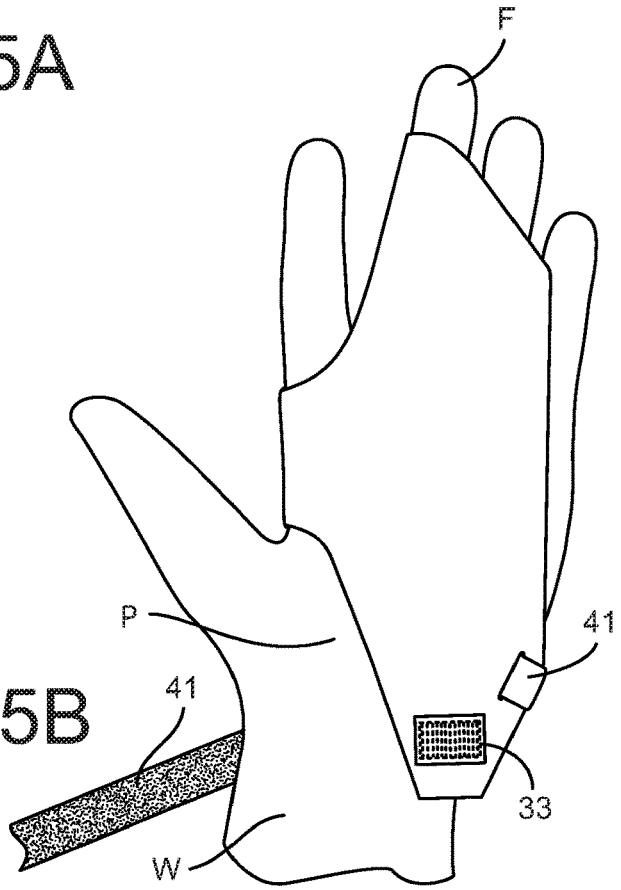
Figure 6A:
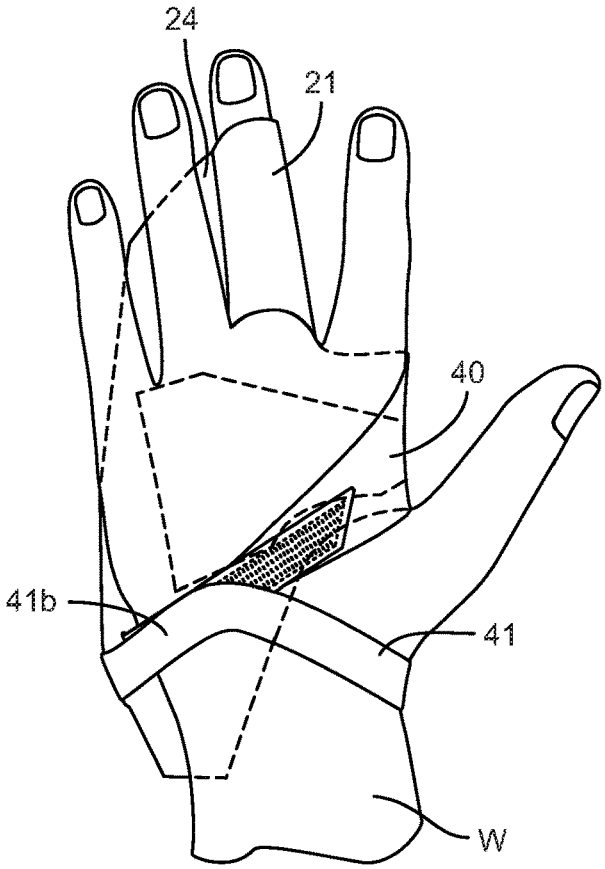
FIGS. 6*a*, 6*b* show the golf glove of FIGS. 1-2 on a golfer's hand in a final stage of placing the glove on the hand.
Figure 6B:
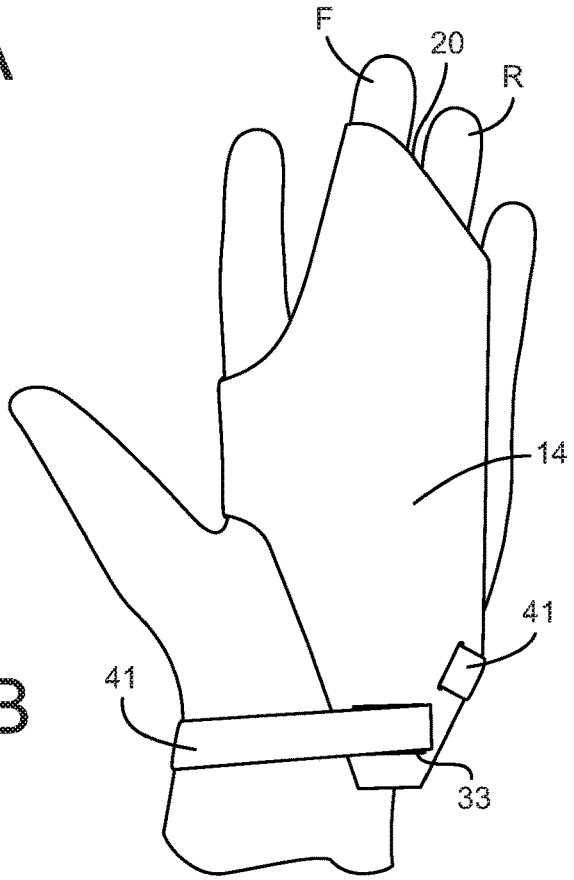

As shown in FIGS. 5*a*-5*b*, the attachment strap 41 is wrapped back across the back of the golfer's hand. It can be appreciated that the slot 31 is positioned in the attachment flap 30 so that the slot is not oriented on the palm P of the golfer's hand when the strap is wrapped back across the back of the hand. This orientation prevents the strap from impinging on the gripping surface at the palm of the golfer's hand. The surface 41*a* (FIG. 1) of the strap 41 is configured to removably engage the attachment pad 43 on the opposite side of the strap portion 12, as best seen in FIG. 5*a*. In particular, the segment 41*b* of the strap engages the attachment pad. As discussed above, the attachment interface can be a hook-and-loop type fastening. The strap is directed across the hand to the wrist W. Then, as shown in FIGS. 6*a*-6*b* (and particularly FIG. 6*b*), the surface 41*a* of the attachment strap 41 is directed across the palm side of the golfer's wrist W to engage the attachment pad 33 of the attachment flap 30. It can be appreciated that the golfer can readily adjust the tightness of the glove on the hand by disengaging the strap from the two attachment pads 33, 43, pulling the strap tighter (or loosening the strap) and then re-engaging the strap surface 41*a* to the two attachment pads.

Figure 7:
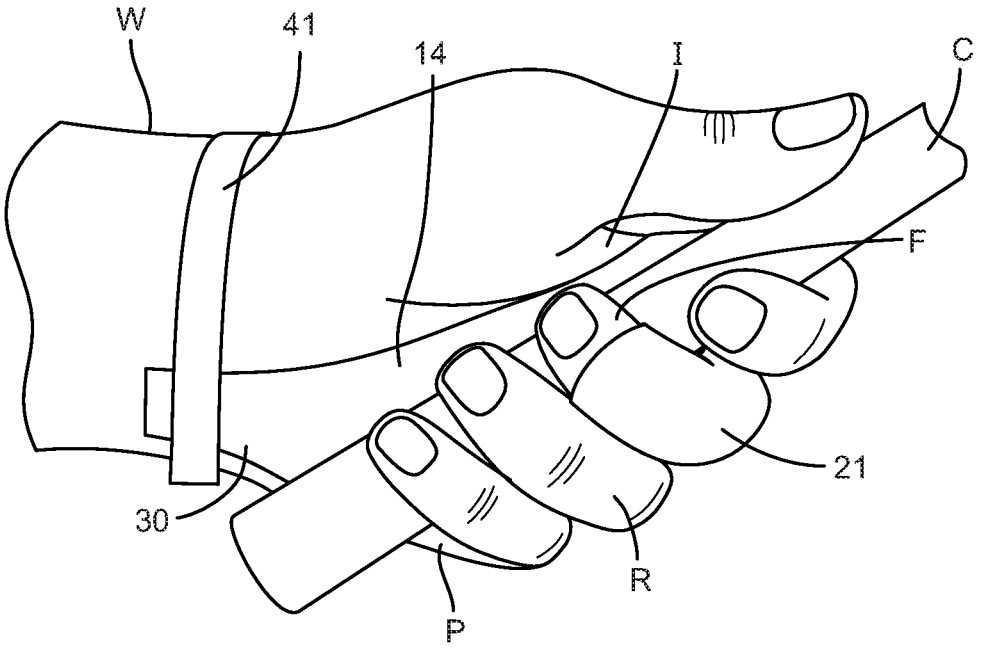
FIG. 7 is a perspective view of a golfer gripping a golf club while wearing the glove shown in FIGS. 1-2.

With the glove on the hand, the golfer can grip the golf club C in his/her standard fashion, as illustrated in FIG. 7. As can be seen, all of the golfer's fingertips are exposed, and the entirety of three fingers and the thumb are exposed and in contact with the golf club. This significantly enhances the golfer's "feel" when gripping the club. The palm section 14 of the glove contacts the golf club C across the portion of the hand critical to gripping the club. The finger portion 20 also contacts the club at a critical gripping location, protecting the fingers F, R and providing an additional gripping surface for a firm grip on the club during a golf swing. As explained above, the palm portion 14 can be formed of a material suitable for a firm grip on the club. The club-facing surface can be provided with grip-enhancing features as desired, such as pads or dimples of high-friction material.

In addition to improving the golfer's "feel" when swinging the club, the glove 10 provides additional benefits not achieved by conventional golf gloves. In particular, the glove limits the amount of the hand that is covered, virtually eliminating any problem sweating. Significantly, the back of the hand is almost entirely exposed. Obviously, covering the back of the hand is immaterial to the ability to grip the club, so removing material from that part of the glove will not affect the performance of the glove. Furthermore, keeping most of the hand and the fingertips exposed allows the golfer to use his/her gloved hand to do almost anything. One problem with traditional golf gloves is that the gloves make it difficult for a golfer to retrieve something from his/her pockets. The limited glove surface allows the golfer to readily place a hand in a pants pocket to retrieve a ball marker for instance. Moreover, since the ring finger R is exposed the golfer can wear a ring without concern, no matter how extravagant and large the ring is. For that matter, the base of all four fingers and the thumb are exposed so that a ring can be worn on any digit without a problem.

The golf glove 10 of the present disclosure is a significant departure from the conventional golf or sports glove. In particular, the majority of the glove can be formed as a unitary pattern in a single sheet of material. The palm portion 14, finger portion 20, attachment flap 30 and at least part of the strap portion 12 can be part of the unitary pattern from the single sheet 11 of material. The edges of the unitary pattern can be folded over and attached by sewing or adhesion to add strength and wear resistance to the portions. The finger sleeve 21, palm panel 15 and attachment strap 41 can be attached to the sheet 11 by conventional means, such as sewing and adhesion. The finger sleeve, palm panel and attachment strap can be formed of the same or a different material than the single sheet 11 that forms the unitary pattern. For instance, the finger sleeve can be formed of an elastic material. The palm panel can be formed of a material designed for a comfortable feel on the palm of the golfer's hand. The attachment strap can include a releasable attachment surface on one side, such as a hook-and-loop fastener, and/or can be slightly elastic. Although it is contemplated that the glove, and particularly the sheet 11, would be formed from a leather, hide or fabric material, other materials are contemplated that may be suitable for gripping a golf club, such as a pliant plastic material.

The shape of the unitary pattern of the sheet 11 can be modified from the shape shown in FIGS. 1-2 provided that the palm portion 14 is retained substantially as shown to provide a gripping surface sufficient for a firm grip on a golf club during a golf swing. Thus, the finger portion 20 may be modified to be limited to only the finger sleeve 21. The finger sleeve may be arranged to receive the ring finger R rather than the middle finger F, with or without the finger flap 24. The size of the palm portion 14 may also be modified, provided that the modified shape maintains sufficient coverage of the golfer's palm and orients the attachment flap 30 with the golfer's wrist W for engagement with the strap 41 wrapped around the wrist.

However, in one modification of the glove 10, the attachment pad 33 can be eliminated. In this modification, the strap 41 only engages the attachment pad 43 on the back side of the strap portion 12. Thus, referring to FIGS. 5*a*, 6*a* the attachment strap 41 can be limited to the segment 41*b* that is engaged to the pad 43.

Figure 8:
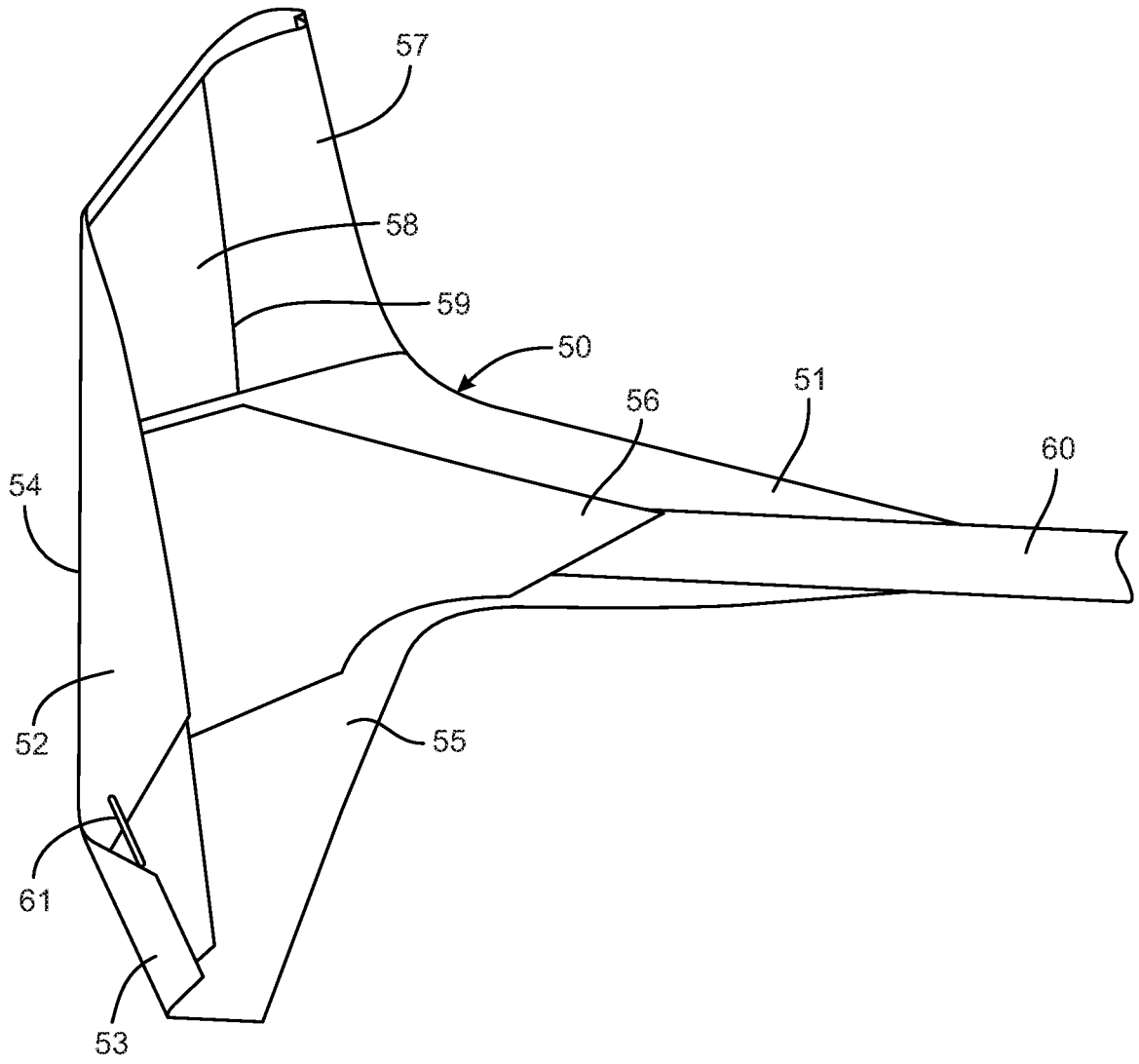
FIG. 8 is a plan view of a golf glove according to a further embodiment of the present disclosure.

In a further modification shown in FIG. 8, the glove 50 includes a sheet of material 51 that is slightly modified from the sheet or pattern 11 in FIG. 1. In particular, the sheet or pattern 51 includes folded portions 52 and 53 that are folded across the lateral edge 54 of the glove. The folded portions 52, 53 are sewn or otherwise affixed to the palm portion 55. The folded portions thus add material and strength to the lateral edge 54. A palm panel 56 may also be affixed to the palm portion, in a manner similar to panel 15 discussed above. A strap 60 and strap slot 61 may be added to the pattern 51 similar to the strap 41 and slot 31 described above.

In a further modification, the finger sleeve 57 can constitute a sheet of material that span across the top of the pattern 51. A base portion 58 of the panel is affixed to the finger portion of the pattern 51 by sewing or other suitable manner, with particular attention to the seam line 59 that defines the finger sleeve 57 so that the user can insert his/her finger into the sleeve. In this modification, the finger sleeve 57 and base portion 58 can be formed of a common sheet of elastic material, such as Spandex.

The present disclosure should be considered as illustrative and not restrictive in character. It is understood that only certain embodiments have been presented and that all changes, modifications and further applications that come within the spirit of the disclosure are desired to be protected.

What is claimed is:

1. A golf glove for the hand of a golfer, comprising:

a sheet including a surface configured for contacting a grip of a golf club and an opposite surface configured for contacting only a portion of the golfer's hand, the sheet including a palm portion sized and configured to cover less than the entire palm of the golfer's hand and a finger portion sized and configured to cover only a portion of the middle and ring fingers of the golfer's hand;

an elongated finger sleeve attached to the finger portion of the sheet, said finger sleeve sized and configured to receive only the middle finger of the golfer's hand therethrough; and a single strap portion attached to said sheet adjacent said finger sleeve, said strap portion configured and arranged to be wrapped around the wrist of the golfer's hand.

2. The golf glove of claim 1, wherein said elongated finger sleeve has a length along said finger portion of the sheet, said finger sleeve having an opening at the end of said length that is configured so that the fingertip of the middle finger is exposed when the glove is worn on the golfer's hand.

3. The golf glove of claim 1, wherein said finger portion is sized and configured so that the finger tip of the ring finger of the golfer is exposed when the glove is worn on the golfer's hand.

4. The golf glove of claim 1, wherein:

said sheet includes an attachment flap below said palm portion, said attachment flap configured and arranged to extend to the golfer's wrist when the glove is worn on the golfer's hand; and said attachment flap defining a slot sized and configured to receive said strap portion therethrough.

5. The golf glove of claim 4, wherein:

said attachment flap further includes a first attachment pad; and said first attachment pad and said strap portion are configured for a removable engagement between the strap portion and the attachment pad.

6. The golf glove of claim 5, wherein said first attachment pad includes a hook-and-loop fastener.

7. The golf glove of claim 5, wherein said strap portion includes a second attachment pad arranged on said strap portion for removable engagement with said strap portion when said strap portion extends through said slot.

8. The golf glove of claim 1, further comprising a palm panel affixed to said sheet, said palm panel configured to contact the palm of the golfer's hand when the glove is worn on the hand.

9. The golf glove of claim 1, wherein said palm portion, said finger portion and at least part of said strap portion are formed as a pattern in a single common sheet of material.

10. The golf glove of claim 9, wherein the single common sheet of material is a leather, hide or fabric configured for gripping a golf club grip.

11. The golf glove of claim 2, wherein:

said sheet is formed of a first material configured for gripping a golf club; and said finger sleeve is formed of a material different from the material of said sheet.

12. The golf glove of claim 11, wherein said finger sleeve is formed of an elastic material.

13. The golf glove of claim 12, wherein the elastic material is Spandex.

* * * * *